US008613349B1

(12) United States Patent
Halko et al.

(10) Patent No.: US 8,613,349 B1
(45) Date of Patent: Dec. 24, 2013

(54) SUITCASE TABLETOP SYSTEM

(76) Inventors: Monica E. Halko, Granada Hills, CA (US); Karen Heitz, Palos Verdes Estates, CA (US)

( * ) Notice: Subject to any disclaimer, the term of this patent is extended or adjusted under 35 U.S.C. 154(b) by 0 days.

(21) Appl. No.: 13/568,971

(22) Filed: Aug. 7, 2012

(51) Int. Cl.
*B65D 85/00* (2006.01)

(52) U.S. Cl.
USPC ..... 190/11; 206/320; 190/8; 190/18 A; 280/37; 280/47.18

(58) Field of Classification Search
USPC ..... 190/11, 8, 18 A; 108/42, 47; 206/320; 224/155; 280/37, 47.18
See application file for complete search history.

(56) References Cited

U.S. PATENT DOCUMENTS

| | | | | |
|---|---|---|---|---|
| 3,557,916 | A * | 1/1971 | Stowell | 190/11 |
| 5,437,367 | A | 8/1995 | Martin | |
| D403,899 | S | 1/1999 | Paparo, Jr. | |
| 6,105,508 | A | 8/2000 | Ryburg | |
| 6,471,019 | B1 | 10/2002 | Miller | |
| 6,644,447 | B2 | 11/2003 | Pohl | |
| 6,932,427 | B2 * | 8/2005 | Tamura | 297/217.1 |
| 7,114,602 | B2 | 10/2006 | Chen | |
| 8,146,722 | B1 * | 4/2012 | Moreno et al. | 190/18 A |
| 2005/0098402 | A1 * | 5/2005 | Cohen | 190/12 A |
| 2005/0194226 | A1 * | 9/2005 | Wang et al. | 190/8 |
| 2007/0089952 | A1 * | 4/2007 | Herbst et al. | 190/8 |
| 2008/0217129 | A1 * | 9/2008 | Whelan | 190/8 |
| 2009/0255771 | A1 * | 10/2009 | Puchalski | 190/18 A |
| 2010/0236884 | A1 | 9/2010 | Brown | |
| 2011/0056788 | A1 * | 3/2011 | Jackson | 190/2 |

* cited by examiner

*Primary Examiner* — Anthony Stashick
*Assistant Examiner* — Cynthia Collado

(57) ABSTRACT

The present invention features a portable suitcase tabletop system having a suitcase with a generally u-shaped telescopic handle and a plurality of wheels located on the suitcase bottom surface. The system has a table with a table bottom surface pivotally attached to a generally u-shaped telescopic table mount. A first table mount rod is located in a first table mount tube and a second table mount rod is located in a second table mount tube. The first table mount tube and the second table mount tube are located on a suitcase rear surface. In a first closed position, the table is located parallel with and pivoted against the suitcase rear surface. In a second open position, the table is pivoted into a position on a plane parallel with the suitcase top surface.

4 Claims, 10 Drawing Sheets

SUITCASE TABLETOP SYSTEM

BACKGROUND OF THE INVENTION

The basic concept of luggage has not changed significantly over the years with the exception of simple improvements such as implementing new sizes, materials of construction or convenience features such as wheels or telescopic handles. Traditionally, luggage such as carryon bags, duffle bags, trunks, totes and suitcases have been primarily used to carry clothing or other personal items when traveling. Because a traveler, along with his luggage, often spends time waiting for a connecting flight, a bus, or a taxi, the present invention features a portable suitcase tabletop system to provide a useful table surface for working and other uses.

SUMMARY

The present invention features a portable suitcase tabletop system. In some embodiments, the system comprises a generally hollow suitcase with a generally u-shaped telescopic handle. In some embodiments, the suitcase comprises a plurality of wheels located on the suitcase bottom surface close to the suitcase rear surface.

In some embodiments, the system comprises a generally planar table. In some embodiments, a table bottom surface is pivotally attached to a generally u-shaped telescopic table mount. In some embodiments, a first table mount rod is located in a first table mount tube and a second table mount rod is located in a second table mount tube. In some embodiments, the first table mount tube and the second table mount tube are located on a suitcase rear surface. In some embodiments, a plurality of horizontal support mount bars is located on the first table mount tube and the second table mount tube. In some embodiments, a first foldable locking support and a second foldable locking support are pivotally located on the table bottom surface for engaging the horizontal support mount bar.

In some embodiments, in a first closed position, the table is located parallel with and pivoted against the suitcase rear surface between the suitcase top surface and the suitcase bottom surface. In some embodiments, in a second open position, the table is pivoted into a position on a plane parallel with the suitcase top surface. In some embodiments, the first table mount rod is telescopically extended out from a first table mount tube and the second table mount rod is telescopically extended out from a second table mount tube. In some embodiments, a first foldable locking support second end is located on the horizontal support mount bar with the first foldable locking support fully extended and locked into position. In some embodiments, a second foldable locking support second end is located on the horizontal support mount bar with the second foldable locking support fully extended and locked into position.

Any feature or combination of features descried herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
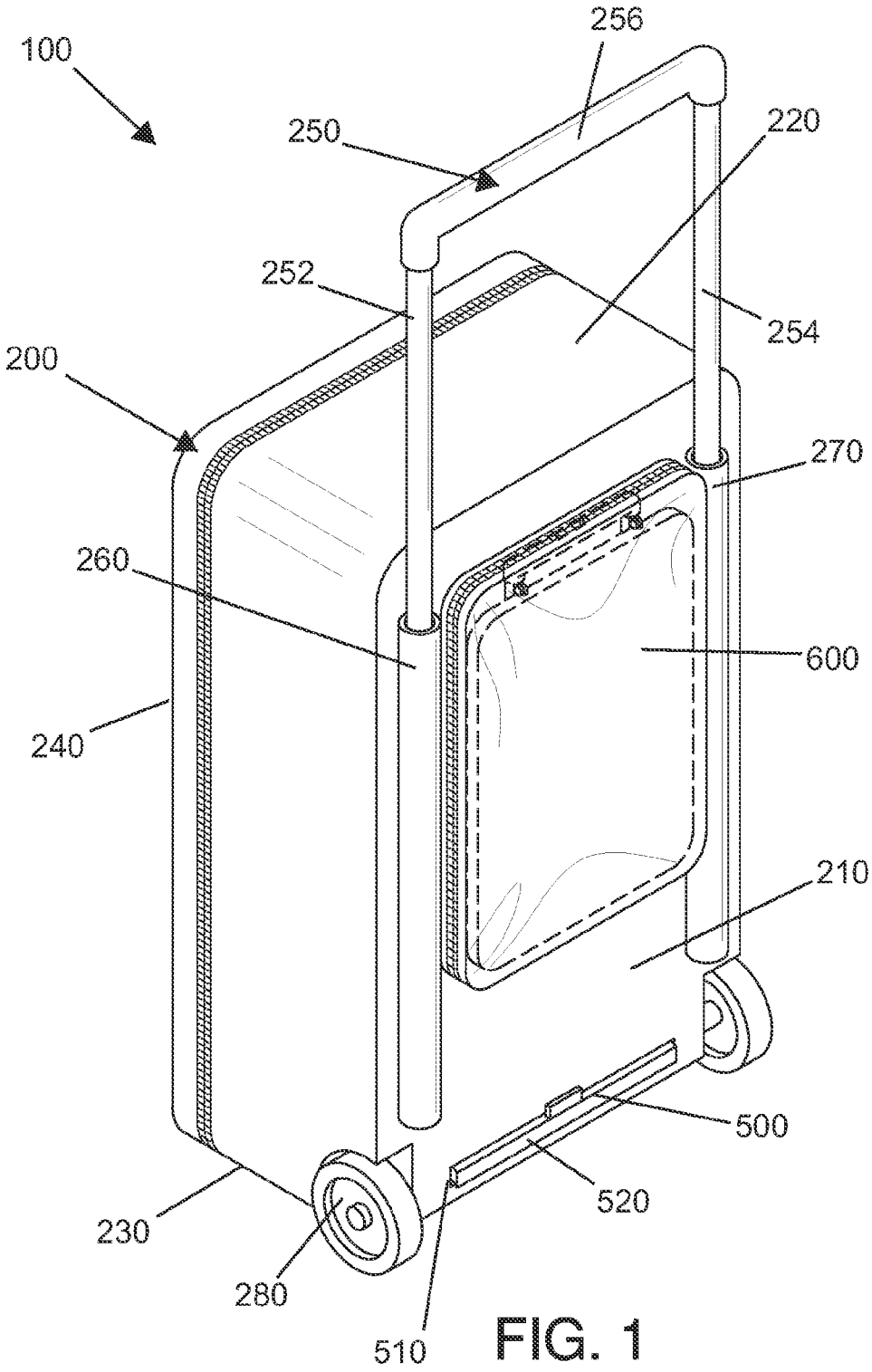
FIG. 1 is a rear perspective view of the present invention.
Figure 2:
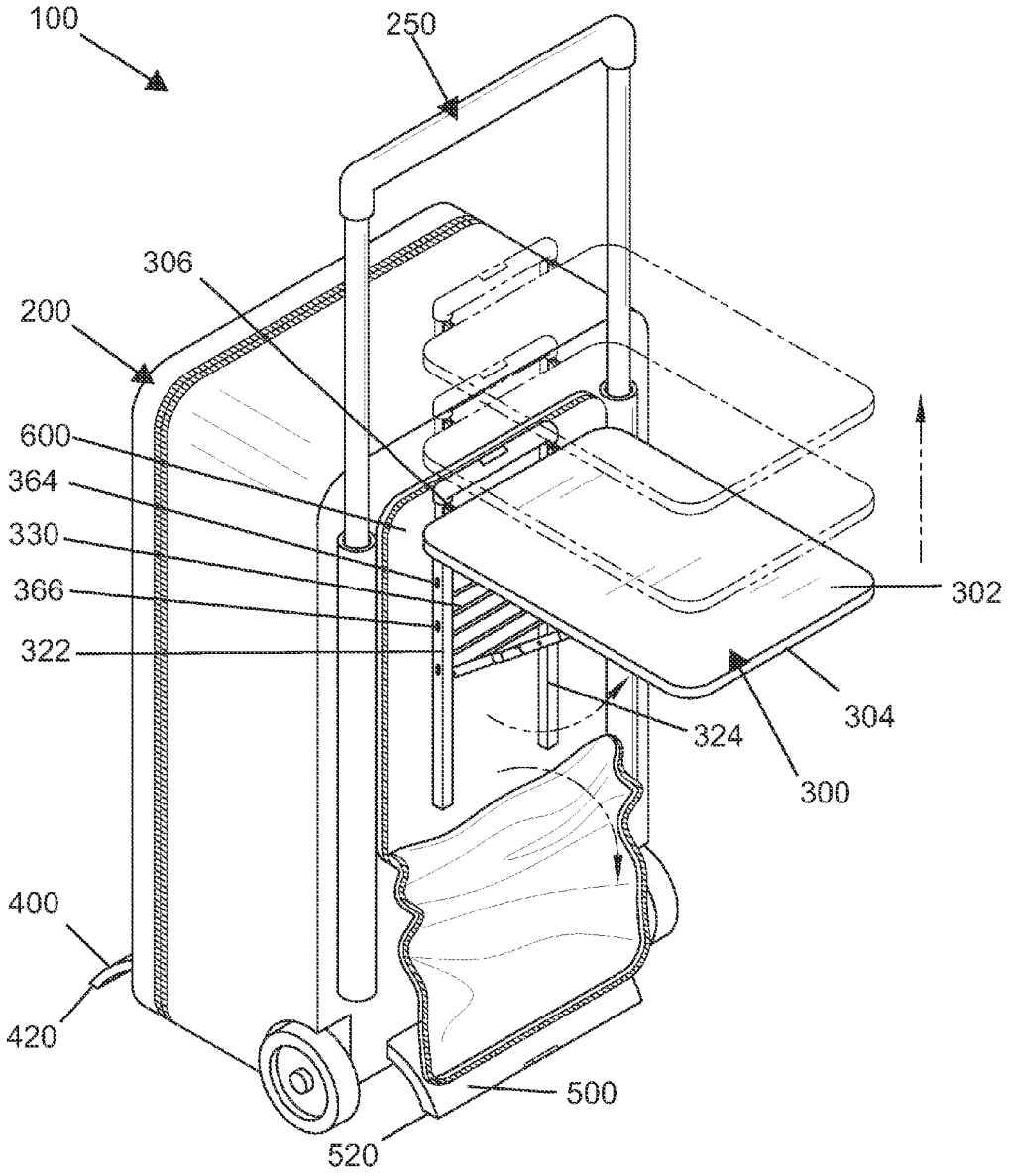
FIG. 2 is a rear perspective view of the present invention.
Figure 3:
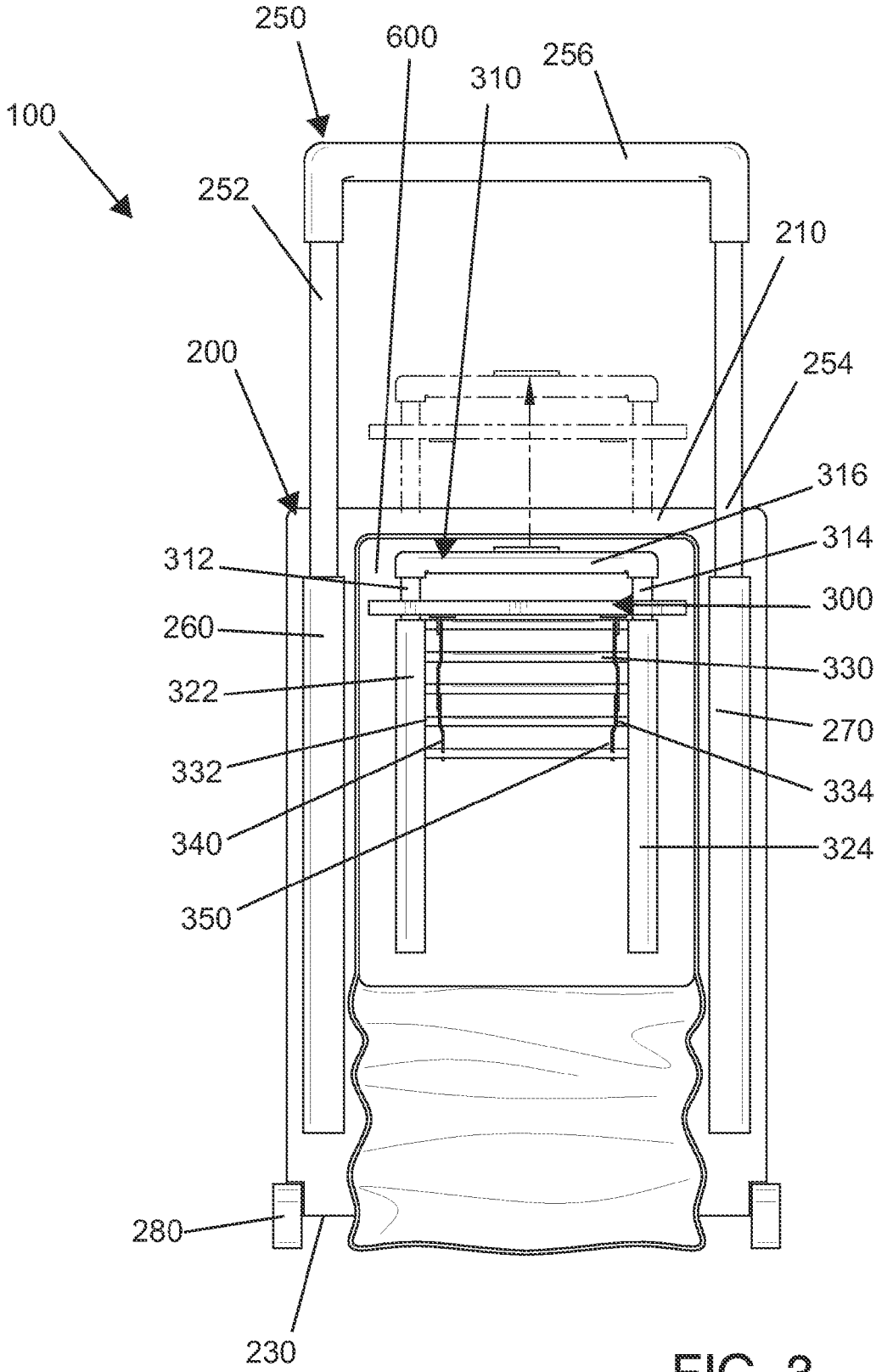
FIG. 3 is a rear view of the present invention.
Figure 4:
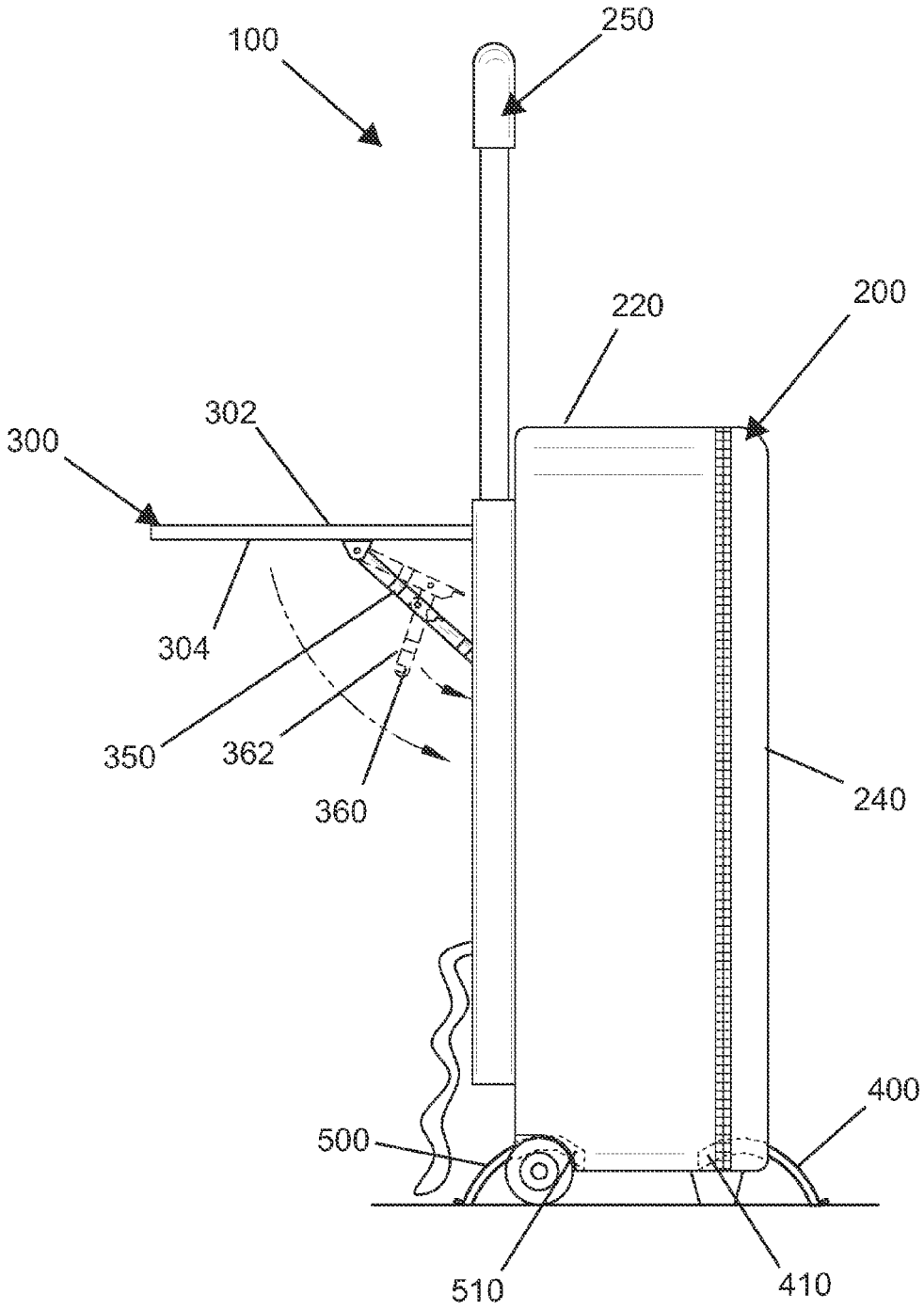
FIG. 4 is a side view of the present invention.
Figure 5:
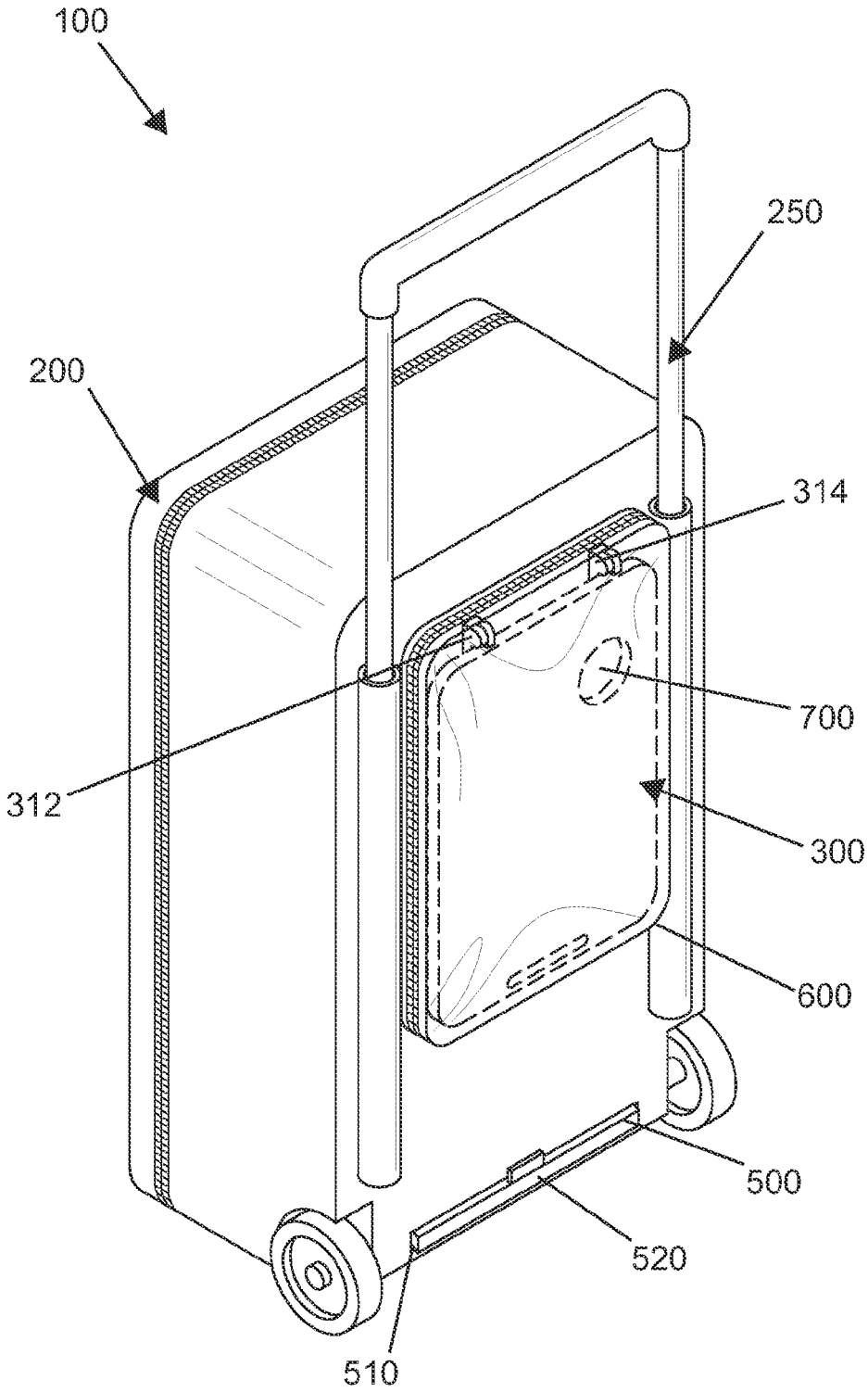
FIG. 5 is a rear perspective view of an alternate embodiment of the present invention.
Figure 6:
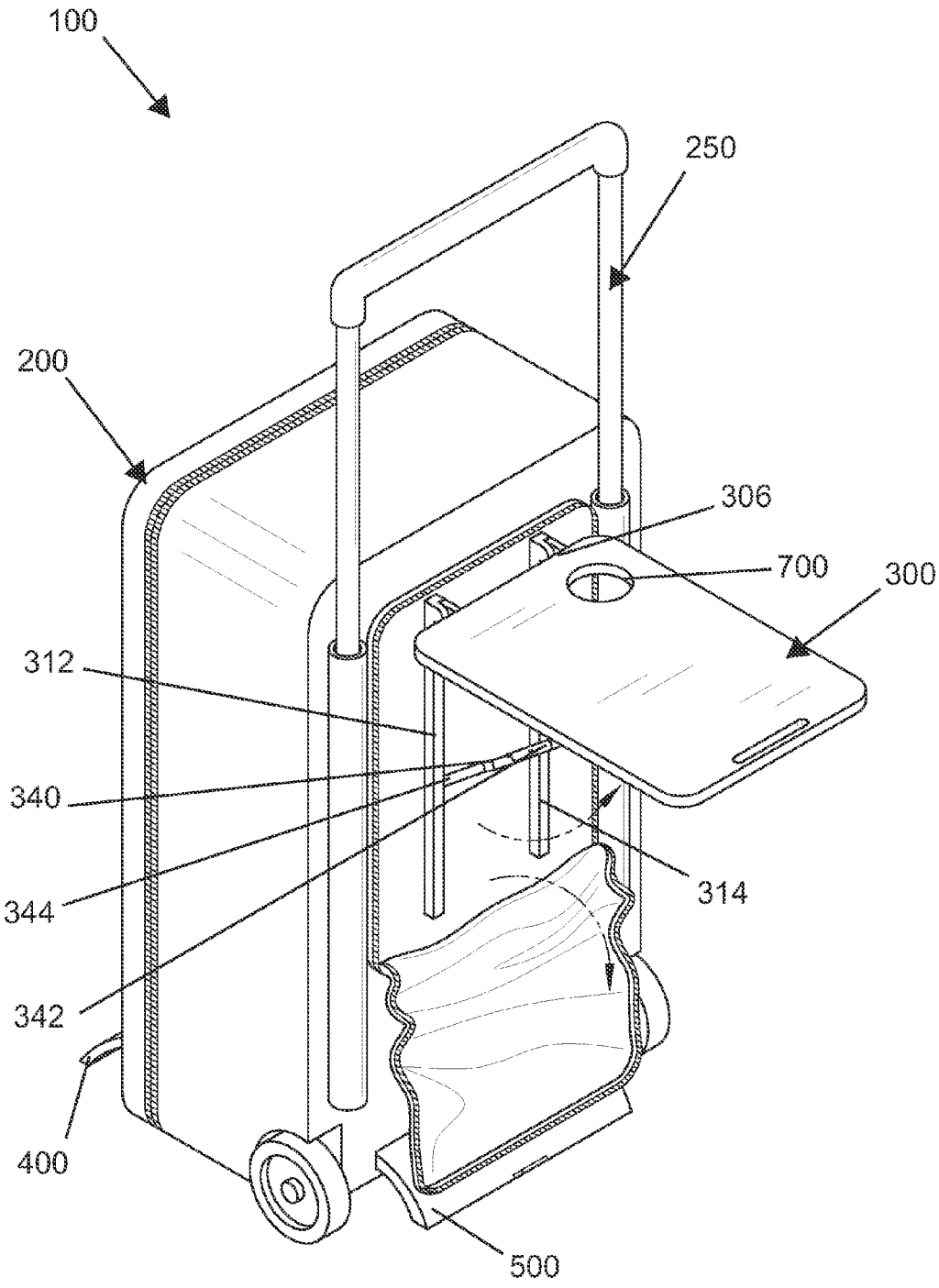
FIG. 6 is a rear perspective view of an alternate embodiment of the present invention.
Figure 7:
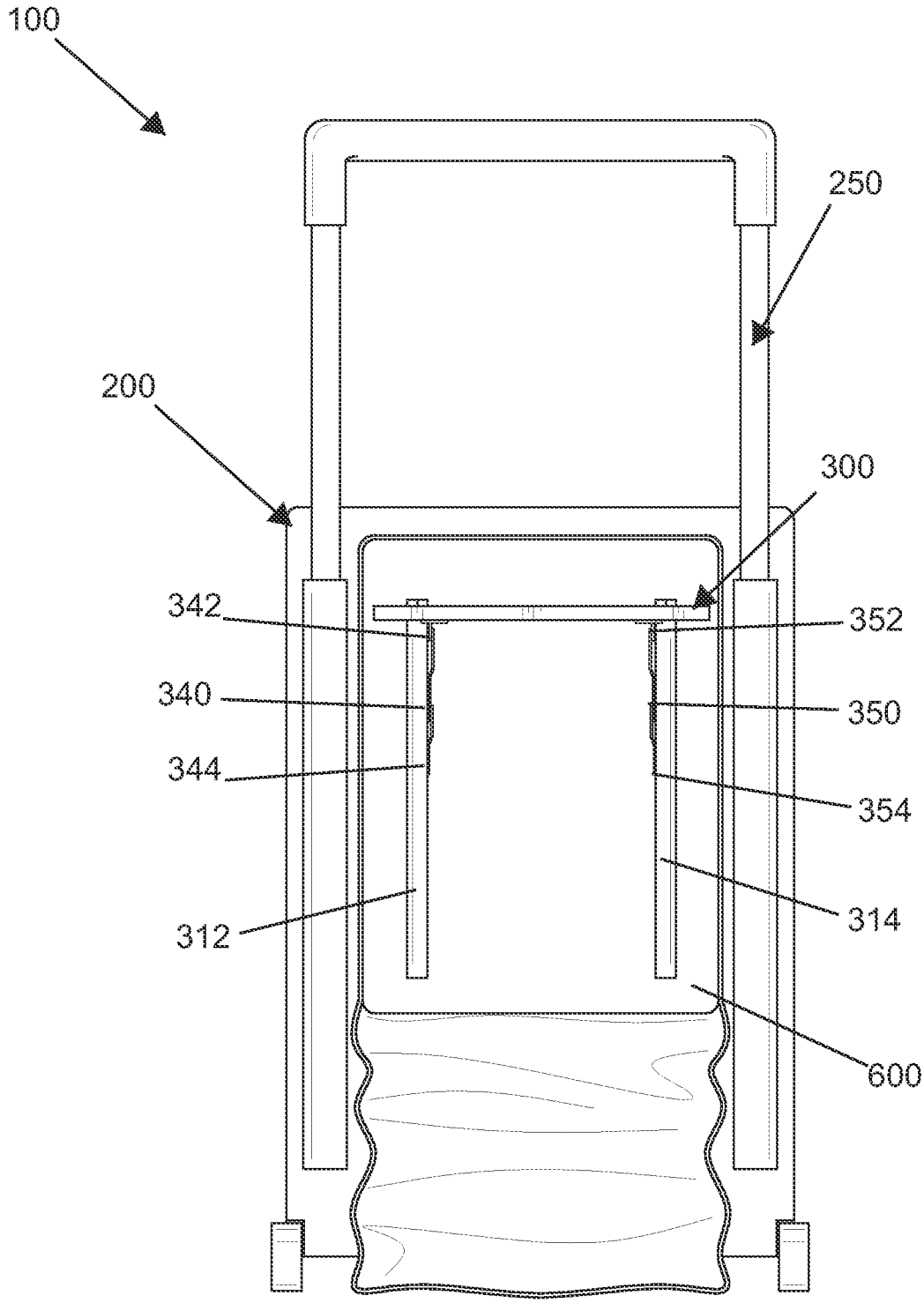
FIG. 7 is a rear view of an alternate embodiment of the present invention.
Figure 8:
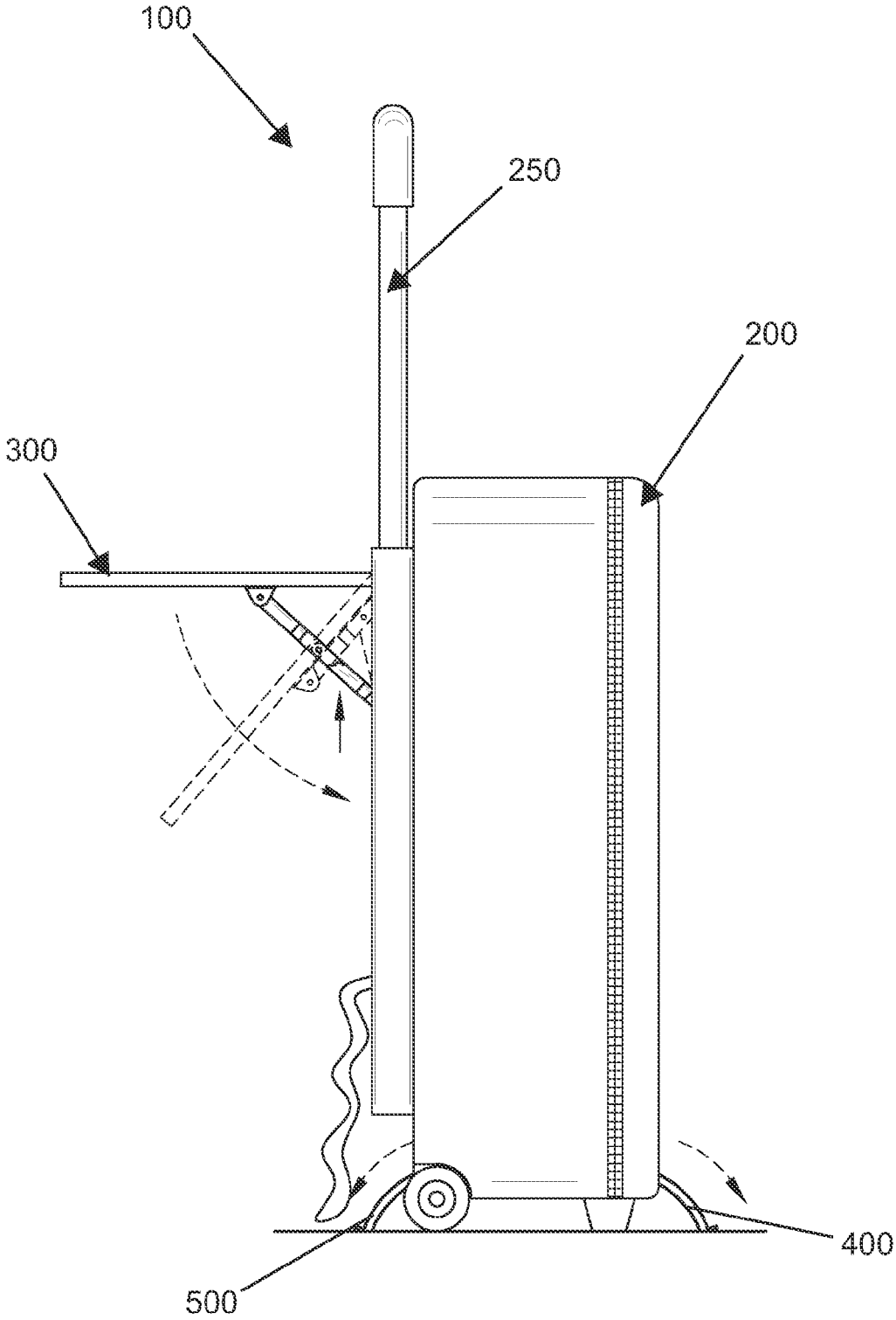
FIG. 8 is a side view of an alternate embodiment of the present invention.
Figure 9:
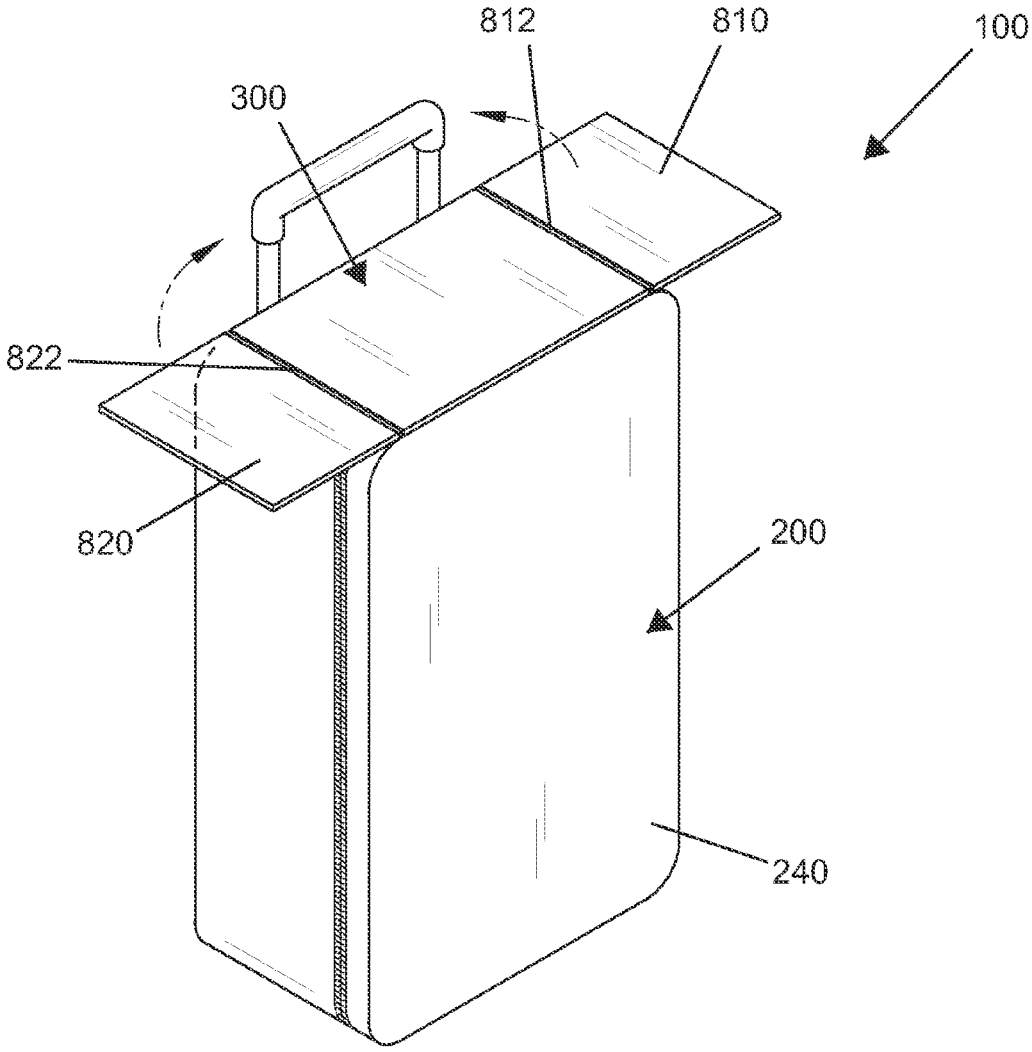
FIG. 9 is a front perspective view of an alternate embodiment of the present invention.
Figure 10:
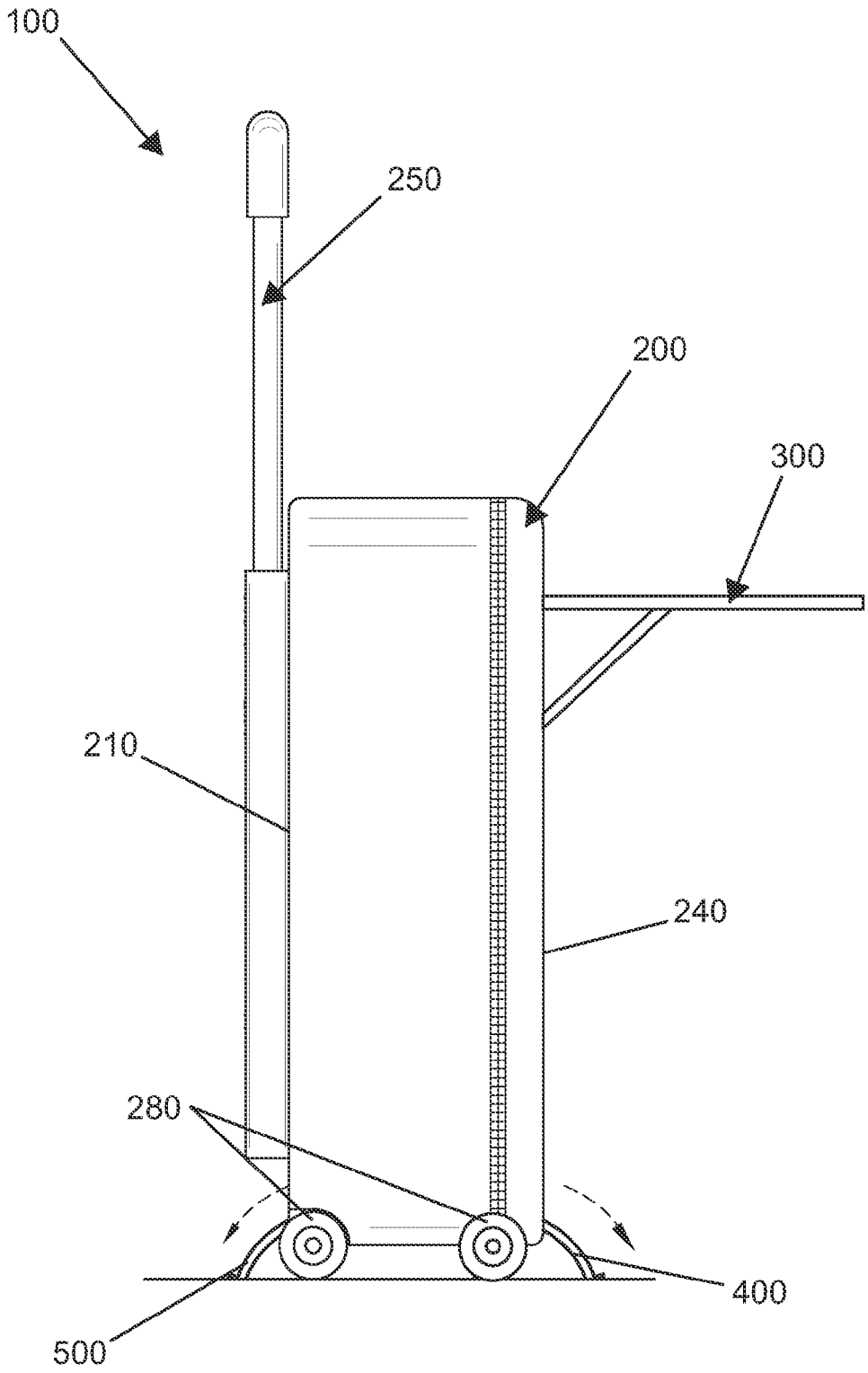
FIG. 10 is a side view of an alternate embodiment of the present invention.

Following is a list of elements corresponding to a particular element referred to herein:

100 Portable suitcase tabletop system
200 Suitcase
210 Suitcase rear surface
220 Suitcase top surface
230 Suitcase bottom surface
240 Suitcase front surface
250 Telescopic handle
252 First handle rod
254 Second handle rod
256 Top handle rod
260 First handle tube
270 Second handle tube
280 Wheel
300 Table
302 Table top surface
304 Table bottom surface
306 Table edge
310 Table mount
312 First table mount rod
314 Second table mount rod
316 Top table mount rod
322 First table mount tube
324 Second table mount tube
330 Horizontal support mount bar
332 Support mount bar first end
334 Support mount bar second end
340 First foldable locking support
342 First locking support first end
344 First locking support second end
350 Second foldable locking support
352 Second locking support first end
354 Second locking support second end
360 Slot
362 Side edge
364 Spring loaded pin
366 Aperture
400 Front support
410 Front support cavity
420 Front support edge
500 Rear support
510 Rear support cavity
520 Rear support edge
600 Storage compartment
700 Cup aperture
810 First table panel
812 Table first side
820 Second table panel
822 Table second side Referring now to FIG. 1-10, the present invention features a portable suitcase tabletop system (100). In some embodiments, the system (100) comprises a generally hollow suitcase (200) having a generally rigid suitcase rear surface (210), a suitcase top surface (220), a suitcase bottom surface (230), and a suitcase front surface (240). In some embodiments, the suitcase (200) comprises a generally u-shaped unitary telescopic handle (250) having a first handle rod (252), a second handle rod (254), and a top handle rod (256). In some embodiments, the telescopic handle (250) is slidably attached to the suitcase rear surface (210) via a first handle tube (260) and a second handle tube (270). In some embodiments, the top handle rod (256) is located parallel to the suitcase top surface (220). In some embodiments, the suitcase (200) comprises a plurality of wheels (280) located on the suitcase bottom surface (230) close to the suitcase rear surface (210).

In some embodiments, the system (100) comprises a generally planar table (300) having a table top surface (302), a table bottom surface (304), and a table edge (306). In some embodiments, the table (300) is pivotally attached to a generally u-shaped unitary telescopic table mount (310) having a first table mount rod (312), a second table mount rod (314), and a top table mount rod (316). In some embodiments, the first table mount rod (312) is located parallel to the second table mount rod (314). In some embodiments, the top table mount rod (316) is located parallel to the suitcase top surface (220). In some embodiments, the first table mount rod (312) and the second table mount rod (314) are located close to a table edge (306). In some embodiments, the top table mount rod (316) is located at an offset above and away from the table top surface (302) to enable space for gripping by a hand of a user.

In some embodiments, the first table mount rod (312) is slidably located in a first table mount tube (322) and the second table mount rod (314) is slidably located in a second table mount tube (324). In some embodiments, the first table mount tube (322) and the second table mount tube (324) are located on the suitcase rear surface (210) parallel with respect to each other and perpendicular to the suitcase bottom surface (230). In some embodiments, the first table mount tube (322) and the second table mount tube (324) are located on the suitcase front surface (240) parallel with respect to each other and perpendicular to the suitcase bottom surface (230).

In some embodiments, a plurality of horizontal support mount bars (330) are perpendicularly located, each having a support member bar first end (332) located on an inside surface of the first table mount tube (322) and a support mount bar second end (334) located on an inside surface of the second table mount tube (324).

In some embodiments, a first foldable locking support (340) comprises a first locking support first end (342) pivotally located on the table bottom surface (304) and a first locking support second end (344) having a slot (360) located on a side edge (362) thereon for hooking on the horizontal support mount bar (330). In some embodiments, a second foldable locking support (350) comprises a second locking support first end (352) pivotally located on the table bottom surface (304) and a second locking support second end (354) having a slot (360) located on a side edge (362) thereon for hooking on the horizontal support mount bar (330).

In some embodiments, in a first closed position, the table (300) is located parallel with and pivoted against the suitcase rear surface (210) between the suitcase top surface (220) and the suitcase bottom surface (230). In some embodiments, in a first closed position, the table (300) is located parallel with and pivoted against the suitcase front surface (240) between the suitcase top surface (220) and the suitcase bottom surface (230). In some embodiments, the first table mount rod (312) is telescopically collapsed into a first table mount tube (322) and the second table mount rod (314) is telescopically collapsed into a second table mount tube (324). In some embodiments, a first locking support second end (344) is released from the horizontal support mount bar (330) with the first foldable locking support (340) folded into a retracted position for storage. In some embodiments, a second locking support second end (354) is released from the horizontal support mount bar (330) with the second foldable locking support (350) folded into a retracted position for storage.

In some embodiments, in a second open position, the table (300) is pivoted into a position parallel with the suitcase top surface (220). In some embodiments, the first table mount rod (312) is telescopically extended out from the first table mount tube (322) and the second table mount rod (314) is telescopically extended out from the second table mount tube (324). In some embodiments, the first locking support second end (344) is located on the horizontal support mount bar (330) with the first foldable locking support (340) fully extended and locked into position. In some embodiments, the second locking support second end (354) is located on the horizontal support mount bar (330) with the second foldable locking support (350) fully extended and locked into position.

In some embodiments, the first table mount rod (312) comprises a first spring loaded pin (364) located on a side thereon. In some embodiments, the first spring loaded pin (364) engages one of a plurality of first apertures (366) located on a side of the first table mount tube (322). In some embodiments, the first spring loaded pin (364) is depressed by a user for slidably adjusting the height of the table (300). In some embodiments, the second table mount rod (314) comprises a second spring loaded pin (364) located on a side thereon. In some embodiments, the second spring loaded pin (364) engages one of a plurality of second apertures (366) located on a side of the second table mount tube (324). In some embodiments, the second spring loaded pin (364) is depressed by a user for slidably adjusting the height of the table (300).

In some embodiments, a front support (400) is slidably located in a front support cavity (410). In some embodiments, the front support cavity (410) is located in the suitcase front surface (240) close to the suitcase bottom surface (230). In some embodiments, in a first retracted position, the front support (400) is fully retracted into the front support cavity (410). In some embodiments, in a second extended position, the front support (400) is extended from the front support cavity (410). In some embodiments, the front support (400) locks into the second position, having a front support edge (420) that interfaces with a ground surface. In some embodiments, the front support (400) is for stabilizing the suitcase (200).

In some embodiments, a rear support (500) is slidably located in a rear support cavity (510). In some embodiments, the rear support cavity (510) is located in the suitcase rear surface (210) close to the suitcase bottom surface (230). In some embodiments, in a first retracted position, the rear support (500) is fully retracted into the rear support cavity (510). In some embodiments, in a second extended position, the rear support (500) is extended from the rear support cavity (510). In some embodiments, the rear support (500) locks into the second position having a rear support edge (520) that interfaces with a ground surface. In some embodiments, the rear support (500) is for stabilizing the suitcase (200).

In some embodiments, the suitcase (200) comprises a storage compartment (600) located on the suitcase rear surface (210). In some embodiments, the suitcase (200) comprises a storage compartment (600) located on the suitcase front surface (240). In some embodiments, the storage compartment (600) at least partially contains the table (300).

In some embodiments, the table (300) comprises a cup aperture (700) for receiving a drinking cup.

In some embodiments, a portable suitcase tabletop system (100) comprises a generally hollow suitcase (200) having a generally rigid suitcase rear surface (210), a suitcase top surface (220), a suitcase bottom surface (230), and a suitcase front surface (240). In some embodiments, the suitcase (200) comprises a generally u-shaped telescopic handle (250) having a first handle rod (252), a second handle rod (254), and a top handle rod (256). In some embodiments, the telescopic handle (250) is slidably attached to the suitcase rear surface (210) via a first handle tube (260) and a second handle tube (270). In some embodiments, the top handle rod (256) is located parallel to the suitcase top surface (220). In some embodiments, the suitcase (200) comprises a plurality of wheels (280) located on the suitcase bottom surface (230) close to the suitcase rear surface (210).

In some embodiments, the system (100) comprises a generally planar table (300) having a table top surface (302), a table bottom surface (304), and a table edge (306). In some embodiments, the table (300) is located on the suitcase top surface (220).

In some embodiments, the table (300) comprises a first table panel (810) pivotally located on a table first side (812) and a second table panel (820) pivotally located on a table second side (822).

In some embodiments, a portable suitcase tabletop system (100) comprises a generally hollow suitcase (200) having a generally rigid suitcase rear surface (210), a suitcase top surface (220), a suitcase bottom surface (230), and a suitcase front surface (240). In some embodiments, the suitcase (200) comprises a generally u-shaped telescopic handle (250) having a first handle rod (252), a second handle rod (254), and a top handle rod (256). In some embodiments, the telescopic handle (250) is slidably attached to the suitcase rear surface (210) via a first handle tube (260) and a second handle tube (270). In some embodiments, the top handle rod (256) is located parallel to the suitcase top surface (220). In some embodiments, the suitcase (200) comprises a plurality of wheels (280) located on the suitcase bottom surface (230) close to the suitcase rear surface (210).

In some embodiments, the system comprises a generally planar table (300) having a table top surface (302), a table bottom surface (304), and a table edge (306). In some embodiments, the table (300) is pivotally attached to a first table mount rod (312) and a second table mount rod (314). In some embodiments, the first table mount rod (312) is located parallel to the second table mount rod (314).

In some embodiments, the first table mount rod (312) and the second table mount rod (314) are located close to a table edge (306).

In some embodiments, wherein the first table mount rod (312) and the second table mount rod (314) are located on the suitcase rear surface (210) parallel with respect to each other and perpendicular to the suitcase bottom surface (230).

In some embodiments, a first foldable locking support (340) comprises a first locking support first end (342) pivotally located on the table bottom surface (304) and a first locking support second end (344) located on the first table mount rod (312). In some embodiments, a second foldable locking support (350) comprises a second locking support first end (352) pivotally located on the table bottom surface (304) and a second locking support second end (354) located on the second table mount rod (314).

In some embodiments, in a first closed position, the table (300) is located parallel with and pivoted against the suitcase rear surface (210) between the suitcase top surface (220) and the suitcase bottom surface (230). In some embodiments, in a first closed position, the table (300) is located parallel with and pivoted against the suitcase front surface (240) between the suitcase top surface (220) and the suitcase bottom surface (230). In some embodiments, the first foldable locking support (340) is folded into a retracted position for storage, and the second foldable locking support (350) folded into a retracted position for storage.

In some embodiments, in a second open position, the table (300) is pivoted into a position parallel with the suitcase top surface (220). In some embodiments, the first foldable locking support (340) is fully extended and locked into position and the second locking support second end (354) is fully extended and locked into position.

In some embodiments, the suitcase (200) comprises a plurality of wheels (280) located on the suitcase bottom surface (230) close to the suitcase rear surface (210). In some embodiments, the suitcase (200) comprises a plurality of wheels (280) located on the suitcase bottom surface (230) close to the suitcase rear surface (210). In some embodiments, the suitcase (200) comprises a plurality of wheels (280) located on the suitcase bottom surface (230) close to the suitcase front surface (240).

As used herein, the term "about" refers to plus or minus 10% of the reference number. For example, an embodiment wherein the table is about 10 inches in length includes a table that is between 9 and 11 inches in length.

The disclosures of the following U.S. Patents are incorporated in their entirety by reference herein: U.S. Pat. No. D 403,899; U.S. Pat. Pub. No. 2010/0236884; U.S. Pat. Pub. No. 2005/0098402; U.S. Pat. No. 7,114,602; U.S. Pat. No. 6,644,447; U.S. Pat. No. 6,471,019; U.S. Pat. No. 6,105,508; U.S. Pat. No. 5,437,367.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A portable suitcase tabletop system (100), wherein said system (100) comprises:

(a) a generally hollow suitcase (200) having a generally rigid suitcase rear surface (210), a suitcase top surface (220), a suitcase bottom surface (230), and a suitcase front surface (240), wherein the suitcase (200) comprises a generally u-shaped telescopic handle (250) having a first handle rod (252), a second handle rod (254), and a top handle rod (256), wherein the telescopic handle (250) is slidably attached to the suitcase rear surface (210) via a first handle tube (260) and a second handle tube (270), wherein the top handle rod (256) is disposed parallel to the suitcase top surface (220), wherein the suitcase (200) comprises a plurality of wheels (280) disposed on the suitcase bottom surface (230) proximal to the suitcase rear surface (210); and (b) a generally planar table (300) having a table top surface (302), a table bottom surface (304), and a table edge (306), wherein the table (300) comprises a cup aperture (700) for receiving a drinking cup;

wherein the table (300) is pivotally attached to a first table mount rod (312), and a second table mount rod (314), wherein the first table mount rod (312) is disposed parallel to the second table mount rod (314), wherein the first table mount rod (312) and the second table mount rod (314) are disposed on the suitcase rear surface (210);

wherein a first foldable locking support (340) comprises a first locking support first end (342) pivotally disposed on the table bottom surface (304) and a first locking support second end (344) disposed on a middle section of the first table mount rod (312), wherein a second foldable locking support (350) comprises a second locking support first end (352) pivotally disposed on the table bottom surface (304) and a second locking support second end (354) disposed on a middle section of the second table mount rod (314);

wherein in a first closed position, the table (300) is disposed parallel with and pivoted against the suitcase rear surface (210) between the suitcase top surface (220) and the suitcase bottom surface (230) with the first foldable locking support (340) folded into a retracted position for storage and the second foldable locking support (350) folded into a retracted position for storage;

wherein in a second open position, the table (300) is pivoted into a position parallel with the suitcase top surface (220), with the first foldable locking support (340) fully extended and locked into position and the second foldable locking support (350) fully extended and locked into position;

wherein a front support (400) is slidably disposed in a front support cavity (410), wherein the front support cavity (410) is disposed in the suitcase front surface (240) proximal to the suitcase bottom surface (230), wherein in a first retracted position, the front support (400) is fully retracted into the front support cavity (410), wherein in a second extended position, the front support (400) is extended from the front support cavity (410), wherein the front support (400) locks into the second position, having an front support edge (420) that interfaces with a ground surface, wherein the front support (400) is for stabilizing the suitcase (200);

wherein a rear support (500) is slidably disposed in a rear support cavity (510), wherein the rear support cavity (510) is disposed in the suitcase rear surface (210) proximal to the suitcase bottom surface (230), wherein in a first retracted position, the rear support (500) is fully retracted into the rear support cavity (510), wherein in a second extended position, the rear support (500) is extended from the rear support cavity (510), wherein the rear support (500) locks into the second position, having an rear support edge (520) that interfaces with a ground surface, wherein the rear support (500) is for stabilizing the suitcase (200);

wherein the suitcase (200) comprises a storage compartment (600) disposed on the suitcase rear surface (210), wherein the storage compartment (600) at least partially contains the table (300).

2. A portable suitcase tabletop system (100), wherein said system (100) consists of:

(a) a generally hollow suitcase (200) having a generally rigid suitcase rear surface (210), a suitcase top surface (220), a suitcase bottom surface (230), and a suitcase front surface (240), wherein the suitcase (200) consists of a generally u-shaped telescopic handle (250) having a first handle rod (252), a second handle rod (254), and a top handle rod (256), wherein the telescopic handle (250) is slidably attached to the suitcase rear surface (210) via a first handle tube (260) and a second handle tube (270), wherein the top handle rod (256) is disposed parallel to the suitcase top surface (220), wherein the suitcase (200) consists of a plurality of wheels (280) disposed on the suitcase bottom surface (230) proximal to the suitcase rear surface (210); and (b) a generally planar table (300) having a table top surface (302), a table bottom surface (304), and a table edge (306) wherein the table (300) consists of a cup aperture (700) for receiving a drinking cup;

wherein the table (300) is pivotally attached to a first table mount rod (312), and a second table mount rod (314), wherein the first table mount rod (312) is disposed parallel to the second table mount rod (314), wherein the first table mount rod (312) and the second table mount rod (314) are disposed on the suitcase rear surface (210);

wherein a first foldable locking support (340) consists of a first locking support first end (342) pivotally disposed on the table bottom surface (304) and a first locking support second end (344) disposed on a middle section of the first table mount rod (312), wherein a second foldable locking support (350) consists of a second locking support first end (352) pivotally disposed on the table bottom surface (304) and a second locking support second end (354) disposed on a middle section of the second table mount rod (314);

wherein in a first closed position, the table (300) is disposed parallel with and pivoted against the suitcase rear surface (210) between the suitcase top surface (220) and the suitcase bottom surface (230) with the first foldable locking support (340) folded into a retracted position for storage and the second foldable locking support (350) folded into a retracted position for storage;

wherein in a second open position, the table (300) is pivoted into a position parallel with the suitcase top surface (220), with the first foldable locking support (340) fully extended and locked into position and the second foldable locking support (350) fully extended and locked into position;

wherein a front support (400) is slidably disposed in a front support cavity (410), wherein the front support cavity (410) is disposed in the suitcase front surface (240) proximal to the suitcase bottom surface (230), wherein in a first retracted position, the front support (400) is fully retracted into the front support cavity (410), wherein in a second extended position, the front support (400) is extended from the front support cavity (410), wherein the front support (400) locks into the second position, having an front support edge (420) that interfaces with a ground surface, wherein the front support (400) is for stabilizing the suitcase (200);

wherein a rear support (500) is slidably disposed in a rear support cavity (510), wherein the rear support cavity (510) is disposed in the suitcase rear surface (210) proximal to the suitcase bottom surface (230), wherein in a first retracted position, the rear support (500) is fully retracted into the rear support cavity (510), wherein in a second extended position, the rear support (500) is extended from the rear support cavity (510), wherein the rear support (500) locks into the second position, having an rear support edge (520) that interfaces with a ground surface, wherein the rear support (500) is for stabilizing the suitcase (200);

wherein the suitcase (200) consists of a storage compartment (600) disposed on the suitcase rear surface (210), wherein the storage compartment (600) at least partially contains the table (300).

3. A portable suitcase tabletop system (100), wherein said system (100) comprises:

(a) a generally hollow suitcase (200) having a generally rigid suitcase rear surface (210), a suitcase top surface (220), a suitcase bottom surface (230), and a suitcase front surface (240), wherein the suitcase (200) comprises a generally u-shaped telescopic handle (250) having a first handle rod (252), a second handle rod (254), and a top handle rod (256), wherein the telescopic handle (250) is slidably attached to the suitcase rear surface (210) via a first handle tube (260) and a second handle tube (270), wherein the top handle rod (256) is disposed parallel to the suitcase top surface (220), wherein the suitcase (200) comprises a plurality of wheels (280) disposed on the suitcase bottom surface (230) proximal to the suitcase rear surface (210); and (b) a generally planar table (300) having a table top surface (302), a table bottom surface (304), and a table edge (306), wherein the table (300) comprises a cup aperture (700) for receiving a drinking cup;

wherein the table (300) is pivotally attached to a first table mount rod (312), and a second table mount rod (314), wherein the first table mount rod (312) is disposed parallel to the second table mount rod (314), wherein the first table mount rod (312) and the second table mount rod (314) are disposed on the suitcase rear surface (210);

wherein a first foldable locking support (340) comprises a first locking support first end (342) pivotally disposed on the table bottom surface (304) and a first locking support second end (344) disposed on a middle section of the first table mount rod (312), wherein a second foldable locking support (350) comprises a second locking support first end (352) pivotally disposed on the table bottom surface (304) and a second locking support second end (354) disposed on a middle section of the second table mount rod (314).

4. The system (100) of claim 3, wherein in a first closed position, the table (300) is disposed parallel with and pivoted against the suitcase rear surface (210) between the suitcase top surface (220) and the suitcase bottom surface (230) with the first foldable locking support (340) folded into a retracted position for storage and the second foldable locking support (350) folded into a retracted position for storage, wherein in a second open position, the table (300) is pivoted into a position parallel with the suitcase top surface (220), with the first foldable locking support (340) fully extended and locked into position and the second foldable locking support (350) fully extended and locked into position.

* * * * *